United States Patent [19]

Avery, Jr.

[11] 4,159,941

[45] Jul. 3, 1979

[54] SEPARATOR

[75] Inventor: Hugh E. Avery, Jr., Houston, Tex.

[73] Assignee: Allied Industries, Inc., Houston, Tex.

[21] Appl. No.: 848,028

[22] Filed: Nov. 14, 1977

Related U.S. Application Data

[63] Continuation of Ser. No. 688,678, May 21, 1976, abandoned.

[51] Int. Cl.[2] ..... B07B 7/04

[52] U.S. Cl. ..... 209/3; 209/138; 209/140

[58] Field of Search ..... 209/132, 133, 138, 139 R, 209/140, 141, 143, 3, 158–161; 55/462

[56] References Cited

U.S. PATENT DOCUMENTS

| | | | |
|---|---|---|---|
| 1,579,660 | 4/1926 | Reilly | 209/143 X |
| 1,950,069 | 3/1934 | Stein | 209/139 A |
| 2,001,184 | 5/1935 | Cuppy | 209/139 R X |
| 2,638,217 | 5/1953 | Niemitz | 209/139 R |
| 2,795,329 | 6/1957 | Schaub | 209/139 R |
| 2,813,318 | 11/1957 | Horth | 209/139 R |
| 3,312,342 | 4/1967 | Brown | 209/136 |
| 3,398,829 | 8/1968 | Brown | 209/140 X |

FOREIGN PATENT DOCUMENTS 589578 12/1933 Fed. Rep. of Germany ..... 209/139 R

*Primary Examiner*—Ralph J. Hill
*Attorney, Agent, or Firm*—Kenway & Jenney

[57] ABSTRACT

Disclosed is an apparatus for separating a pellet-like product from fines (e.g., dust) mixed therewith. The apparatus includes a vertically disposed housing having an upper fines outlet and a lower product outlet. An inlet conduit passes through the housing intermediate the fines outlet and the product outlet and terminates in an upwardly facing inlet nozzle. The inlet conduit receives quantities of product and fines along with a propellant fluid (e.g., pressurized air). An impact baffle is supported within the housing having a concave impact surface that faces the inlet nozzle and that is positioned to intercept the product pellets issuing from the inlet nozzle. The impact baffle is sized and supported to provide an annular flow oriface for the propellant fluid (and fines mixed therewith) between the impact baffle and the housing. A second baffle, supported in the housing adjacent and above the impact baffle, is shaped to define an annular flow conduit that increases in cross section in a direction away from the annular flow oriface. Valve means control the exit velocity of the fines and propellant fluid through the fines outlet.

3 Claims, 1 Drawing Figure

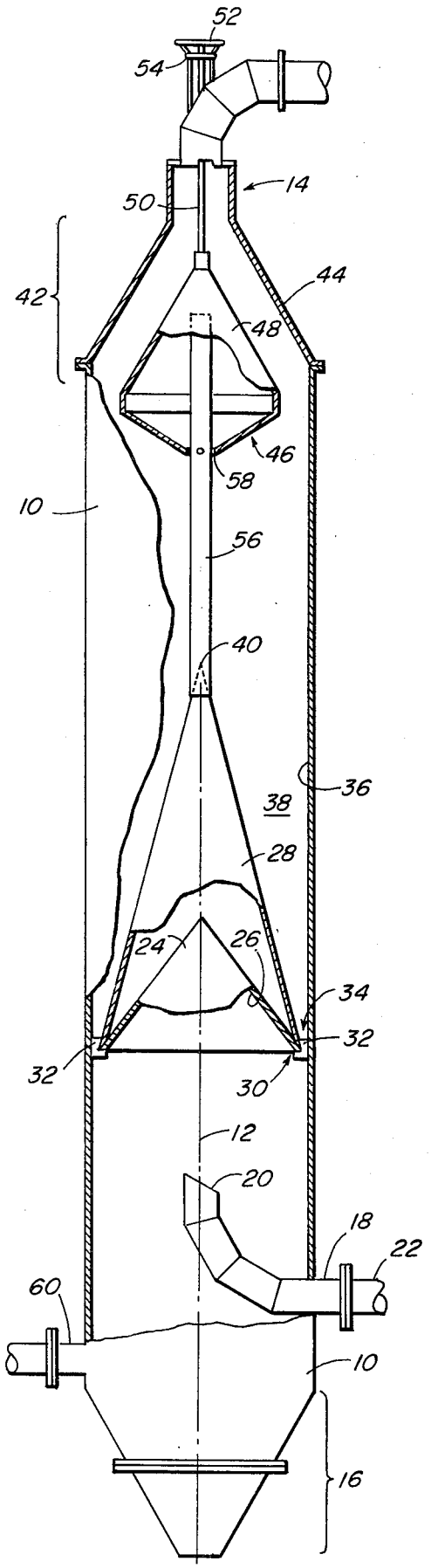
52
54
14
50
42
44
48
46
58
10
56
40
36
38
28
24
26
34
32
32
30
12
20
18
22
60
10
16

SEPARATOR

This is a continuation of United States patent application Ser. No. 688,678, filed May 21, 1976, now abandoned.

BACKGROUND OF THE INVENTION

The present invention relates to apparatus for the separation of a product from quantities of much smaller particles mixed with the product. (Such devices are often referred to in the trade as "elutriators".)

The removal of fines (e.g., dust) from a granular or pellet-like product is a long-standing problem in many industries. Naturally, there have been many proposals for dealing with this problem including washing and settling systems. Vertical air-assisted (e.g., vacuum) separators have also been proposed (e.g., Forsberg, U.S. Pat. No. 2,950,006; Mackenzie et al., U.S. Pat. No. 3,833,117; Mackenzie et al., U.S. Pat. No. 3,904,515; and Thomson U.S. Pat. No. 3,448,856).

The general type of system, as well as the particular constructional details, most suitable for such a separating or cleaning operation can depend upon the physical characteristics of both the product and the impurities. A particular separation problem has grown along with the growth of the modern plastics industry. In many plastic molding and extruding operations the input product to the forming machinery consists of pellets or granules of the particular material involved (e.g., polyethylene).

OBJECTS AND SUMMARY OF THE INVENTION

In view of the above discussion, it is a principal object of the present invention to provide a separator, or elutriator, that can effectively separate pellet-like synthetic plastic material from entrained fines. It is an additional object of the present invention to provide such a separator which is of relatively simple design, is relatively inexpensive to manufacture and maintain, and can operate at relatively high rates.

To achieve these and other objects that shall be evident from the discussion below, a separator according to the present invention comprises a substantially symmetrical housing supported with a vertical axis and having an upper fines outlet and a lower product outlet. An inlet conduit, for receiving quantities of unseparated product along with a propellant fluid, extends into the housing and has an upwardly facing inlet nozzle disposed intermediate the fines outlet and the product outlet. An imperforate impact baffle is supported within the housing and has a concave impact surface facing the inlet nozzle. The impact baffle is sized to provide an annular flow orifice for the propellant fluid (and entrained fines) between that baffle and the housing. A second baffle is supported in the housing adjacent, and above, the impact baffle and is shaped to define, with the housing, an annular flow conduit having a cross section that increases in area in a direction away from the annular flow oriface. Valve means are provided for controlling the exit velocity at the fines outlet. With such an apparatus, the mixture of product and impurities issues from the inlet nozzle and strikes the impact surface of the impact baffle. The momentum of the product pellets is absorbed and they fall downwardly past the inlet nozzle to the product outlet, being too massive to regain an upward momentum from the upwardly traveling propellant fluid as they fall. The fines, however, remain entrained with the propellant fluid (e.g., pressurized air) and travel around the impact baffle, through the annular flow oriface, and to the fines outlet.

In preferred embodiments of the invention the concave impact surface is substantially conical and has an axis of symmetry coincident with the vertical axis of symmetry of the housing; the second baffle is also substantially conical, the first and second baffles being secured together at their bases; the baffles are supported in the housing by a plurality of spaced apart support members around the periphery of the housing; and the apex angle of the second baffle is substantially smaller than that of the first baffle, thereby providing an elongate annular flow conduit of gradually increasing cross section. The decreasing cross section of the annular flow conduit results in a decreasing propellant fluid velocity along that conduit. Any product pellets that inadvertently pass through the annular oriface, therefore, can loose upward momentum in the decreasing velocity region and thereafter fall under the influence of gravity back through the annular orifice and ultimately to the product outlet.

THE DRAWING

There is illustrated in the drawing a vertically disposed separator, or elutriator, partially broken away and partially in section, constructed in accordance with the present invention.

DETAILED DESCRIPTION OF A PARTICULAR PREFERRED EMBODIMENT

Referring to the drawing, the separator comprises a generally cylindrical, vertically disposed housing 10 having a vertical axis 12, an upper fines outlet 14, and a lower product outlet 16. An inlet conduit 18 enters the housing 10 at a lower portion thereof, but above the product outlet 16. The conduit 18, which terminates in an upwardly facing nozzle 20, can be coupled to a product supply conduit 22 that delivers a mixture of product pellets and fines along with a propellant fluid (e.g., pressurized air). The details of such a supply system are conventional and not illustrated.

A conical impact baffle 24 is supported within the housing above the inlet nozzle 20 and is coaxial with the housing 10 and the inlet nozzle 20. The concave surface 26 of the conical baffle 24 faces the inlet nozzle 20 and is located to intercept substantially the entirety of the product issuing upwardly from nozzle 20. A second conical baffle 28 is provided in the housing above the impact baffle 24 and is secured around its base to the base of baffle 24, as at 30. The cone of baffle 28, however, is more elongate than that of baffle 24 (i.e., has a smaller apex angle than the apex angle of baffle 24). The two baffles 24 and 28 are commonly supported at their bases 30 by a series of spaced apart clip supports 32 disposed on a pattern about the inner surface of housing 10. The region between supports 32 provides an annular orifice 34 for air flow, in a manner to be described below. The taper of the outer surface of baffle 28 defines, along with the cylindrical inner surface 36 of housing 10, an annular fluid flow conduit 38 that increases in cross section from the base of baffle 28 to its apex 40.

A valve arrangement 42 is provided above the annular flow conduit 38 and below the fines outlet 14. The valve 42 comprises a tapering portion 44 of the housing 10 and a solid body 46 supported within the housing and having an upper conical portion 48 with a taper matching that of the housing portion 44. The member 46 is supported on a rod 50 which extends to the exterior of the housing and is engaged by a wheel 52. A friction fit of the rod in a plate 54 adjacent the wheel 52 (or, alternatively, a threaded engagement in the plate 54) permits the rod, and thus, the member 46, to be adjusted longitudinally with respect to the housing. Such adjustment, of course, adjusts the spacing between the housing portion 44 and the conical portion 48 of the member 46 to provide a greater or lesser cross sectional area of the exit pass for the propellant fluid and entrained fines. A support rod 56 attached to the apex 40 of baffle 28 extends through a slot 58 in the member 46 to the interior thereof and provides additional support for the member 46, which would otherwise be cantilevered from the rod 50.

A second inlet 60 is provided in the housing 10 intermediate the baffle 24 and the product outlet 16. This inlet can be used to admit "wash air", if such air is required for efficient operation of the separator in addition to the air supplied under pressure through the inlet conduit 18 and nozzle 20.

In operation, the mixed product pellets and fines are projected upwardly from the nozzle 20 and strike the impact surface 26 of the baffle 24. The momentum of the larger product pellets is absorbed and they fall, under the influence of gravity, past the inlet nozzle 20 to the product outlet 16. The propellant air, however, entrains the much lighter fines which are drawn with the air through the annular orifice 34 between the housing and the bases 30 of the conical baffles 24 and 28. By adjusting the velocity of the inlet air issuing from nozzle 20, the exit aperture of the valving arrangement 42, and the quantity of wash air admitted through inlet 60, the velocity of the propellant air through the annular orifice 34 can be adjusted to a value sufficient to convey the fines, but not the more massive pellets, through the orifice 34 and into the top portion of the apparatus.

If any product pellets are inadvertently entrained with the propellant air and pass through the annular orifice 34, the expansion of the annular fluid conduit 38 above orifice 34 causes a substantial reduction in propellant air velocity. This region 38 thus acts as a settling chamber to allow separation of pellets that have inadvertently passed into that region, since the reduced air velocity will be insufficient to drive them upwardly to the fines outlet 14.

The control of air velocity within the various portions of the housing 10 to achieve the desired results is, as suggested above, achieved through a combination of the setting of the valve means 42, the inlet air pressure at the nozzle 20, the area of the annular orifice 34, and the degree of taper of the second baffle 28. An additional controllable parameter for achieving the desired air flow conditions is the wash air inlet 60, which can be used to increase the volume of air entering the system without any increase in the velocity of air issuing from the inlet nozzle 20.

SUMMARY OF THE ADVANTAGES OF THE INVENTION

The vertical orientation of the separator apparatus, coupled with the continuous upward movement of air and fines and the initially upward, and then downward, movement of product pellets, permit a separator construction which is very simple and efficient and which does not require vacuum equipment. By projecting the combined product pellets and fines against a concave impact surface of the baffle system, the momentum of the product pellets is spent and they are permitted to fall to the product outlet. A propellant fluid and entrained fines pass around the baffle system and proceed upwardly to a fines outlet.

While the invention has been described with reference to a particular embodiment, it will be appreciated by those skilled in the art that additions, deletions, modifications, and substitutions or other changes not specifically described may be made which will fall within the scope of the appended claims.

What is claimed is:

1. Apparatus for separating a pellet-like product from fines mixed therewith, comprising:

a substantially symmetrical housing having a vertical axis of symmetry, an upper fines outlet, a lower product outlet, and an intermediate cylindrical portion, an inlet conduit for receiving quantities of said product and fines, along with a pressurized propellant fluid, said inlet extending into said cylindrical housing portion and having an upwardly facing inlet nozzle intermediate said fines outlet and said product outlet, an imperforate conical impact baffle supported within said housing and having a concave impact surface facing said inlet nozzle spaced apart from said inlet nozzle to allow vertical entry of said product and fines and located to intercept substantially the entirety of said product issuing from said inlet nozzle, said impact baffle having an axis of symmetry coincident with the vertical axis of symmetry of said housing, said impact baffle sized to define with said cylindrical housing portion an annular flow orifice for said propellant fluid between said baffle and said housing, a second conical baffle supported in said housing above said impact baffle aligned with said cylindrical housing portion and tapered in an upward direction to define, with said cylindrical housing portion, an annular flow conduit having a conduit cross section that gradually increases in area in a direction away from, and that communicates with, said annular flow orifice, said baffles supported with their circumferences substantially aligned at the annular flow orifice, a valve means for controlling the exit velocity of said fines and propellant fluid through said fines outlet, said valve means including an inwardly tapering portion of said housing adjacent said fines outlet and an imperforate body within said housing having an exterior surface shaped to substantially match the shape of the tapering housing portion, rod means extending from the second baffle to the valve means for supporting the imperforate body, and means for moving said body to adjust the annular gap between said body and said tapering housing portion while also supporting said body; and a wash air inlet in the wall of said housing intermediate said impact baffle and said product outlet.

2. Apparatus as claimed in claim 1 wherein said first and second baffles are secured together at their bases.

3. Apparatus as claimed in claim 2 wherein said first and second baffles are supported in said housing by a plurality of support clips secured to said housing at spaced apart locations around a circumference thereof.

* * * * *